US005351344A

United States Patent [19]

Phillips

[11] Patent Number: 5,351,344

[45] Date of Patent: Oct. 4, 1994

[54] FLUID EVACUATION SYSTEM

[76] Inventor: Rhudy F. Phillips, 1405 Duncan St., Fayetteville, N.C. 28303

[21] Appl. No.: 932,981

[22] Filed: Aug. 20, 1992

[51] Int. Cl.[5] ..... E03D 9/04

[52] U.S. Cl. ..... 4/213; 4/348; 15/328

[58] Field of Search ..... 4/213, 217, 347–352; 15/314, 328, 338

[56] References Cited

U.S. PATENT DOCUMENTS

| | | | |
|---|---|---|---|
| 625,125 | 5/1899 | Scutt | 4/352 |
| 3,069,696 | 12/1962 | Howell | 4/213 |
| 3,122,757 | 3/1964 | Sowards | 4/213 |
| 3,585,651 | 6/1971 | Cox | 4/213 |
| 3,649,972 | 3/1972 | Sowards | 4/211 |
| 3,763,505 | 10/1973 | Zimmerman | 4/213 |
| 3,824,637 | 7/1974 | Hunnicutt, Jr. | 4/213 |
| 3,953,901 | 5/1976 | Poister et al. | 4/213 |
| 4,103,370 | 8/1978 | Arnold | 4/213 |
| 4,133,060 | 1/1979 | Webb | 4/216 |
| 4,200,940 | 5/1980 | Buchanan | 4/348 |
| 4,365,361 | 12/1982 | Sanstrom | 4/213 |
| 4,726,078 | 2/1988 | Carballo et al. | 4/213 |
| 4,766,637 | 8/1988 | Winnicki | 4/661 X |
| 4,984,310 | 1/1991 | Casale | 4/347 |
| 5,016,294 | 5/1991 | Canovas | 4/217 |

*Primary Examiner*—Charles E. Phillips

[57] ABSTRACT

This invention is a fluid evacuation system used in conjunction with a standard water closet. A wet/dry evacuation motor is used to remove foul air not only from the immediate area of the water closet but from the entire room. Should a liquid overflow occur, part of that fluid can also be removed from the top of the water closet bowl and directed into the sewer system. Additionally, an attachment is provided to allow evacuation of water and other fluids from the floor adjacent to and around the water closet.

9 Claims, 3 Drawing Sheets

FLUID EVACUATION SYSTEM

FIELD OF INVENTION

This invention relates to evacuation systems and more particularly to fluid evacuation systems used in bathroom and similar environments.

BACKGROUND OF INVENTION

Since the advent of indoor plumbing, and particularly bathroom fixtures including water closets, a problem has existed in evacuating foul odors from the room, especially from interior rooms without windows. As building codes have been formulated, they usually require that all interior bathrooms include forced air ventilation means. This usually takes the form of forced air blowers in the ceiling to suck out undesirable odors, moisture, and the like.

It was recognized early on that it was more desirable to exhaust foul odors from adjacent the source rather than from other parts of the room.

Various toilet or water closet ventilation systems have been developed including systems for filtering the air from adjacent the toilet seat and blowing it back into the room to exhausting the same through the wall of the room and out a vent pipe. Also systems for ventilating these toilets or water closets to either the standard sewer system vent pipe or directly into the sewer have been developed.

These art systems, however, have drawbacks including 1. possible electrical hazards if liquid overflow occurs, 2. are ineffective in filtering foul odors, particularly in units that exhaust back into the room, 3. are complicated and expensive to manufacture, install and maintain, and 4. some require specially designed and manufactured water closets which effectively prevents retrofit.

BRIEF DESCRIPTION OF INVENTION

After much research and study into the above mentioned problems, the present invention has been developed to provide a low profile fluid evacuation system which has few exposed parts, and those that are exposed are not offensive to view. The system can be readily retrofitted on existing water closets and can be used to evacuate both liquid and gaseous fluids.

The evacuation system of the present invention has the additional advantage of providing a removable vacuum line which can be used to evacuate liquids from the surrounding area including overflow liquids on the floor adjacent the water closet. Automatic and manual switches are provided so that a choice in both when and how long the system is run can be made. This also allows for evacuation of liquids should overflow occur thus greatly reducing the amount of such overflow to adjacent areas.

DISCUSSION OF PRIOR ART

The following references represent the closest prior art of which the inventor is aware:

List of References

U.S. Pat. No. 4,133,060 Issue Date: Jan. 9, 1979 Inventor: Wayne Webb

U.S. Pat. No. 4,103,370 Issue Date: Aug. 1, 1978 Inventor: Douglas L. Arnold

U.S. Pat. No. 625,125 Issue Date: May 16, 1899 Inventor: Delivan W. Scutt

U.S. Pat. No. 3,953,901 Issue Date: May 4, 1976 Inventors: Clarence E. Poister, Phillip A. Tyrrell, Walter D. Hodge Assignee: PK Products, Inc., Wichita, Kans.

U.S. Pat. No. 4,984,310 Issue Date: Jan. 15, 1991 Inventor: Enzo Casale

U.S. Pat. No. 4,726,078 Issue Date: Feb. 23, 1988 Inventors: Rodolfo A. Carballo, Ermidia Carballo U.S. Pat. No. 4,200,940 Issue Date: May 6, 1980 Inventor: Wes Buchanan U.S. Pat. No. 3,824,637 Issue Date: Jul. 23, 1974 Inventor: Clyde J. Hunnicutt, Jr.

U.S. Pat. No. 3,763,505 Issue Date: Oct. 9, 1973 Inventor: Joseph P. Zimmerman

U.S. Pat. No. 5,016,294 Issue Date: May 21, 1991 Inventor: Enrique Canovas

Concise Explanation of References

U.S. Pat. No. 4,133,060 to Webb and U.S. Pat. No. 4,103,370 to Arnold disclosed odorless toilets or water closet that exhaust foul odors into the sewer beyond the water trap of such closet.

U.S. Pat. Nos. 625,125 to Scutt, 3,953,901 to Poister et al and 4,984,310 to Cassale all disclose toilet-type ventilating means that exhaust to the exterior of the room through the rear wall.

U.S. Pat. Nos. 4,726,078 to Carballo et al, 4,200,940 to Buchanan, 3,824,630 to Hunnicutt, Jr. and 3,763,505 to Zimmerman all disclose toilet ventilation means which exhaust filtered air back into the room. Additionally, the first three noted patents show the evacuation motors and filters on the floor of the bathroom next to the toilet where they can create an electrical hazard.

Finally, U.S. Pat. No. 5,0016,294 to Canovas is considered of general interest only in that it discloses an odorless toilet including an under seat manifold with a tube leading to a remote vacuum pump.

OBJECTS OF INVENTION

In view of the above, it is an object of the present invention to provide a low-profile fluid evacuation system that can be readily retrofitted to existing water closets.

Another object of the present invention is to provide a water closet evacuation system that provide for liquid and gaseous evacuation from an area adjacent the rear of the water closet bowl.

Another object of the present invention is to provide a wet/dry vacuum unit for use in conjunction with a water closet fluid evacuation system.

Another object of the present invention is to provide a fluid evacuation system that is low-profile and exhausts fluids under the rear of the water closet into a specially designed closet ring.

Another object of the present invention is to provide a closet ring for use in conjunction with water closets that includes a side inlet for receiving evacuated gaseous and liquid fluids.

Another object of the present invention is to provide a wet/dry vacuum unit for use in conjunction with a water closet fluid evacuation system that is mounted on the rear portion of the water closet bowl.

Another object of the present invention is to provide a vacuum unit for use in conjunction with a water closet fluid evacuation system that is removably mounted on the rear portion of the water closet bowl.

Another object of the present invention is to provide, in a water closet evacuation system, a pressure switch between the seat and the rim of water closet bowl for automatic operation when pressure is applied to such seat.

Another object of the present invention is to provide, in a fluid evacuation system for water closets, both an automatic pressure-sensitive switch and a manual switch for operating of the same.

Other objects and advantages of the present invention will become apparent and obvious from a study of the following description and the accompanying drawings which are merely illustrative of such invention.

DETAILED DESCRIPTION OF THE INVENTION

With further reference to the drawings, the improved evacuation system of the present invention, indicated generally at 10, includes a wet/dry vacuum bypass motor 26 mounted within wet/dry vacuum housing 11.

Wet/dry vacuum bypass motors are used to create a vacuum for picking up both dry and wet debris, etc. Bypass motors are distinguished from thru-flow motors which are for dry vacuums only.

The advantage in using a wet/dry vacuum bypass motor in the present invention is that should moisture from misdirected urine, water closet bowl overflow or the like be encountered, it will be harmlessly discharged into the sewer as will hereinafter be described in greater detail. Also an advantage in using this type of a vacuum source is that the same is protected against electrical shock should a liquid enter into the fluid stream being evacuated.

Since wet/dry vacuum bypass motors are well known to those skilled in the art, further detailed description of the same is not deemed necessary.

Figure 1:
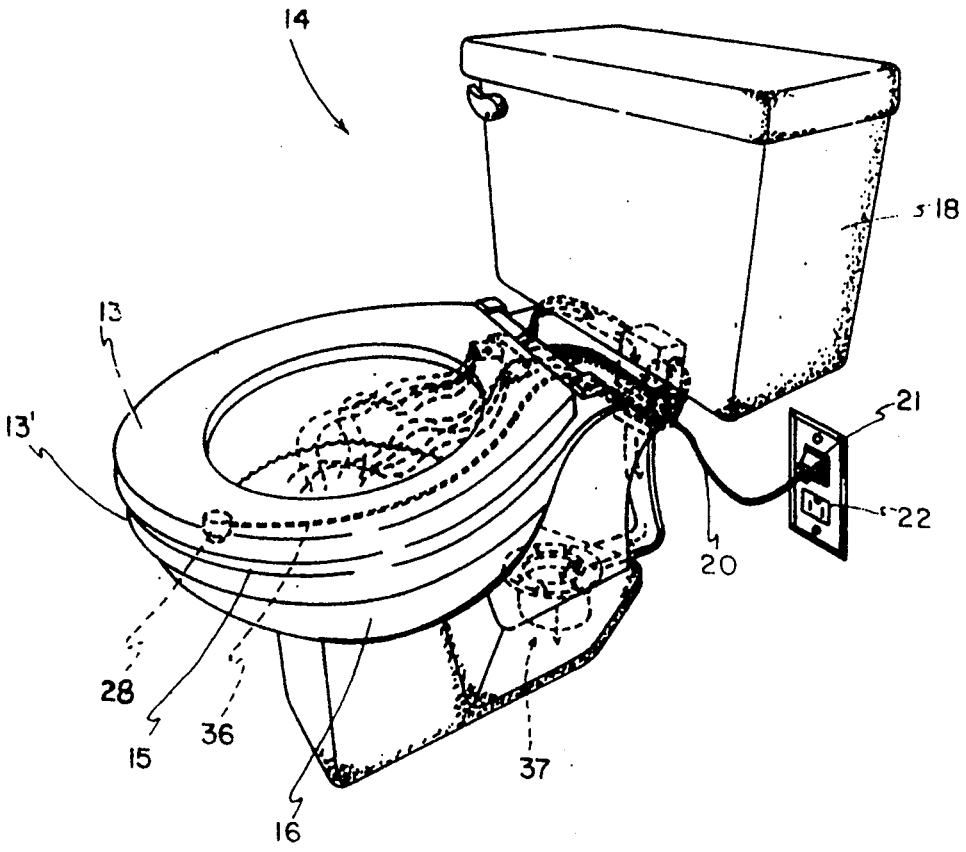
FIG. 1 is a perspective view of a conventional form of toilet bowl with the system of the instant invention operably associated therewith.
Figure 2:
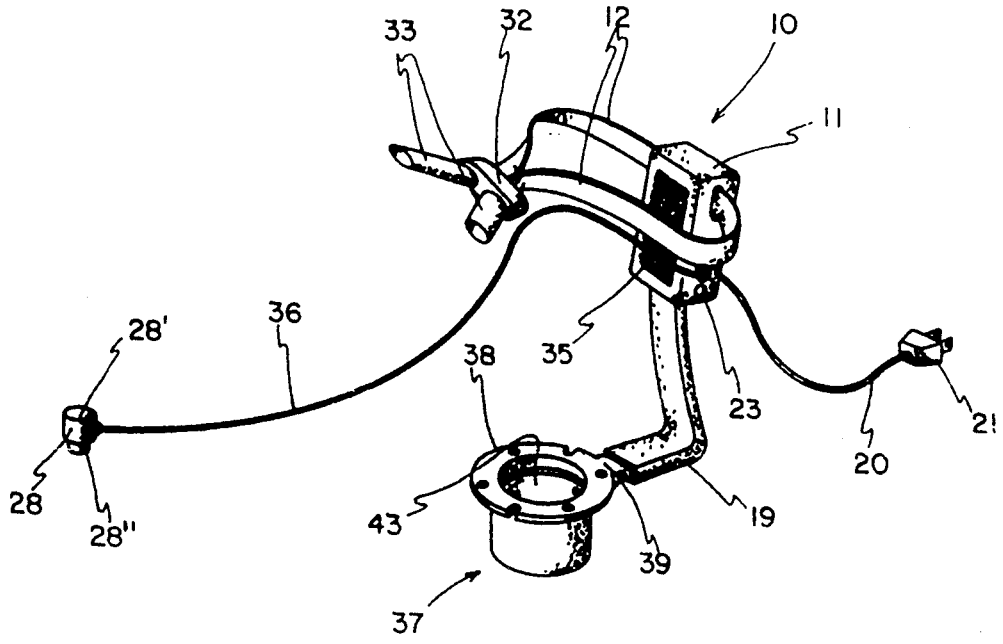
FIG. 2 is a perspective view of the instant device in the absence of the toilet bowl.
Figure 3:
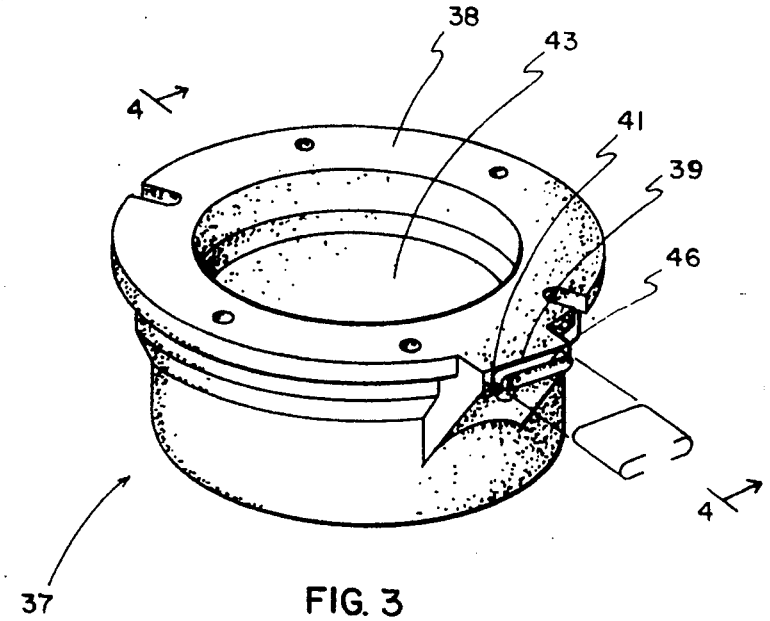
FIG. 3 is a perspective view of the closet ring of the instant invention.

A pair of flexible vacuum inlet hoses 12 are connected to the vacuum source 26 within housing 11 on opposite sides of such housing as can be seen clearly in FIG. 2. These vacuum inlet hoses are preferably relatively flat in configuration and can be generally oval-shaped in cross section to pass readily between the rim 15 of the bowl portion 16 of water closet 14 and the seat 13 when said seat is in the lowered, use position. These hoses also pass unobtrusively around the rear portion 17 of said water closet 14 and into wet/dry vacuum housing 11 mounted thereon below the flush tank 18 as can clearly be seen in FIG. 1.

A flattened exhaust hose 19 is communicatively connected to the wet/dry vacuum source 26 within housing 11 at one end and to a specially designed closet ring 37 at the other end as will hereinafter be described in greater detail.

A standard electrical power cord 20 is provided which has a standard electrical plug 21 at one end thereof which is adapted to fit into a standard electrical wall outlet 22.

The other end of power cord 20 is operatively connected to the inlet side of electrical switch 23. This switch is preferably a single-pole, double-throw switch.

One outlet side of switch 23 is connected through conductors 24 and 25 to the wet/dry vacuum bypass motor 26 operatively mounted within housing 11. The other outlet side of switch 23 is connected through conductor 27 to pressure switch 28. This switch is connected through conductor 29 to timer 30. Timer 30 is connected through conductor 31 to conductor 25 which, as indicated above, is operatively connected to wet/dry vacuum bypass motor 26.

Bypass conductor 27' is connected between conductor 27 and timer 30 to allow current to continue to pass through said timer into motor 26 for a predetermined period of time after pressure switch 28 has been opened.

Since single-pole, double-throw switches, pressure switches, timers and their respective conductors are all well known to those skilled in the art, further detailed discussion of these components of the present invention is not deemed necessary.

The ends 33 of vacuum hoses 12 opposite wet/dry vacuum housing 11 pass through keeper 32 and terminate a short distance therefrom. This keeper is preferably formed from a rubber coefficient to hold the inlet hoses in place during use while at the same time allowing such hoses to be pulled therefrom when it is desired to either clean or replace the same.

The keeper 32 can be held in place relative to the upper surface 17' of the rear portion 17 of the water closet by glue, hook and loop fasteners or other suitable means.

As can clearly be seen in FIG. 2, the inlet ends 33 of inlet hoses 12 extending outwardly from keeper 32 and are disposed in a V-configuration. This allows such inlet ends to more readily and completely remove fumes, noxious odors and other forms of fowl air 34 from the area of the bowl of the water closet as well as from other portions of the room in which the water closet is disposed. Usually, the greatest concentration of fumes and noxious odors originate in the bowl but the vacuum system of the present invention is adequate to remove cigarette smoke, moist air from showers, and other airborne particles from said room or enclosure (not shown).

The wet/dry vacuum housing 11 is preferably removably mounted on the rear portion 17 of the water closet 14 by means such as hook and loop type fasteners 35. The reason for this type removable mounting is to allow the housing and its associated parts to be more readily cleaned and, of course, repaired or replaced as necessary.

Figure 5:
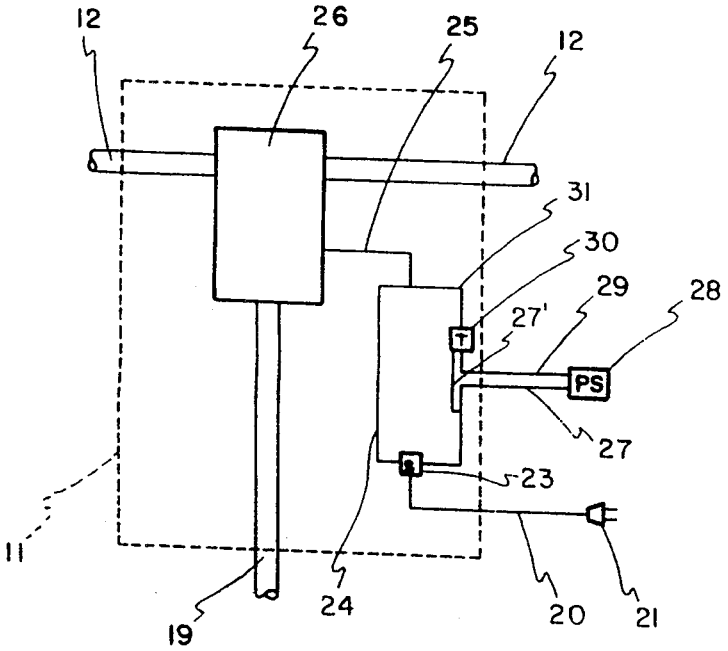
FIG. 5 is a schematic drawing of the electrical system of the invention.
Figure 6:
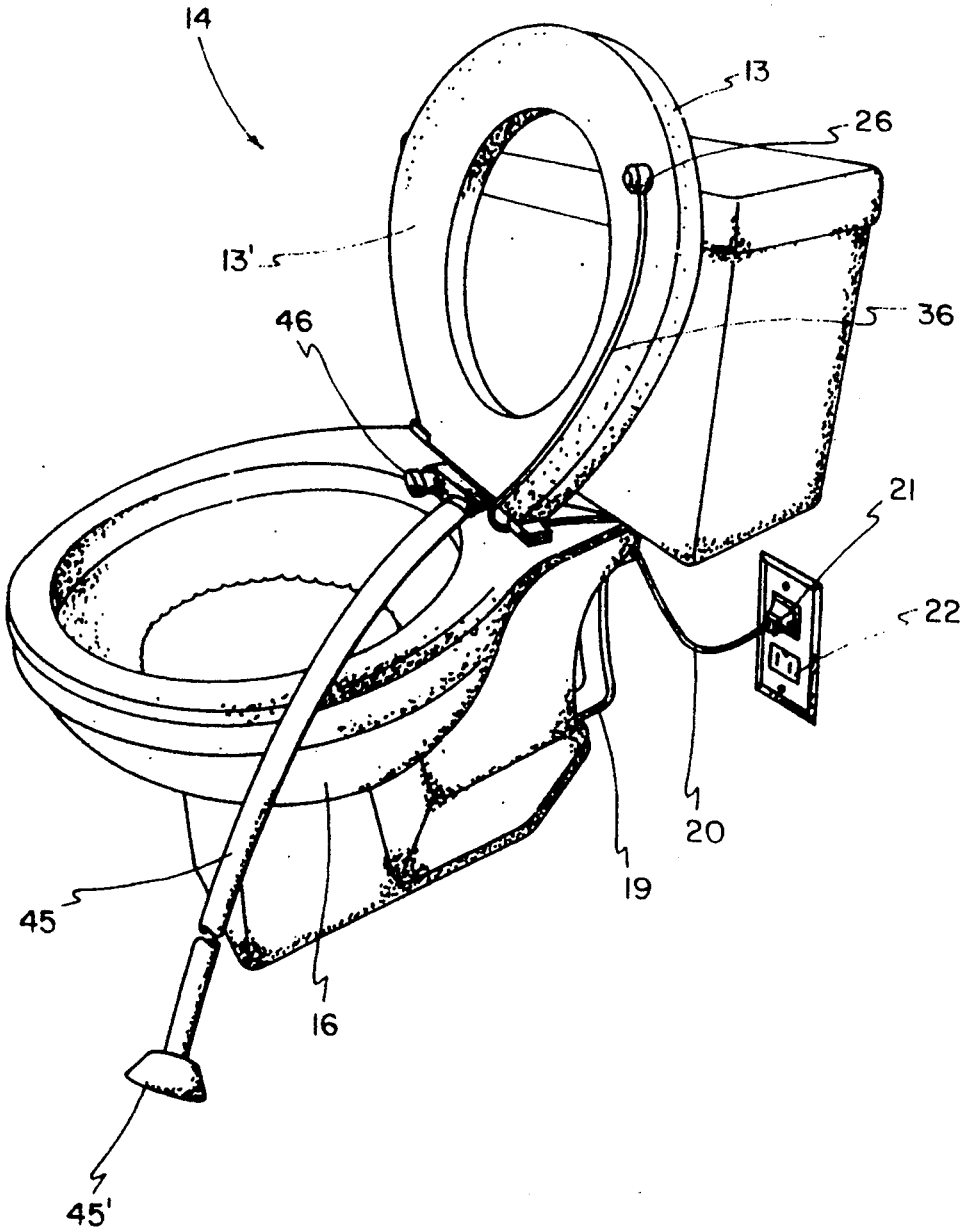
FIG. 6 is a perspective view similar to FIG. 1 showing the use of the auxiliary hose.

The pressure switch conductors 27 and 29 are preferably enclosed within cord covering 36 as can clearly be seen in FIGS. 1, 2 and 5. Pressure switch 28 includes a flat upper portion 28' which can be hook and loop fastened or otherwise attached to the bottom 13' of seat 13.

The contact portion 28'' of pressure switch 28 is preferably spring-loaded and will hold the seat 13 slightly off of its normal rest position on rim 15 of water closet 14. When weight is placed on such seat 13, such as when a person sits thereon, switch portion 28'' will close the circuit through the pressure switch 28 to start the wet/dry vacuum bypass motor 26 through timer 30 as will hereinafter be discussed in greater detail.

The modified closet ring of the present invention, indicated generally at 37, includes a standard-sized closet ring flange 38 for mounting the water closet 14 in the normal manner. At one point the edge of the closet ring flange 38 projects outwardly as indicated at 39. This outward projection includes a hose connecting lip 40 which surrounds opening 41. This opening communicates through passage 42 to the interior 43 of the closet ring and thus communicates with the sewer line associated therewith when the water closet 14 is installed thereon.

Figure 4:
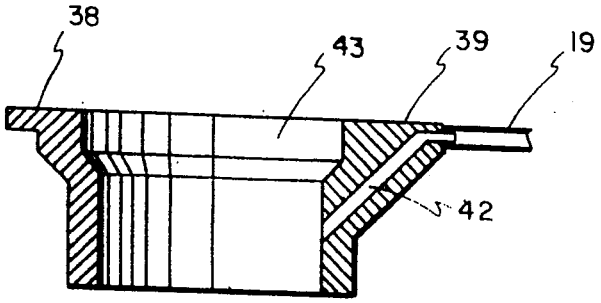
FIG. 4 is a vertical sectional view taken substantially upon the plane indicated by the section line 4—4 of FIG. 3.

The flattened exhaust hose 19 from the wet/dry vacuum passes under the rear portion of water closet 14 and is connected to lip 40 of projection 39 as is clearly seen in FIG. 4. Either a slight depression can be formed in the floor 44 on which the water closet is mounted or the water closet can have a thin passageway formed in the bottom thereof to accept the hose 14. If this is a retrofit, the bottom of the water closet can readily be channeled with a ceramic grinder or other suitable means.

To mount the improved evacuation system of the present invention 10 on a water closet 14, readily available hook and loop fastening means such as that sold under the brand name "Velcro" has one portion secured by adhesive to the rear portion of 17 of such water closet 14. The other portion of the fastener is secured by adhesive to housing 11 as indicated at 35 in FIG. 2.

When the two portions of the loop and hook means are pressed together, they will form a secure mounting for housing 11 on the rear portion 17 of the water closet which is also readily removable when necessary.

The flexible vacuum inlet hoses extend outwardly from opposite sides of housing 11 and are looped around the rear portion 17 of the water closet and back through the openings in the hose keeper 32 so that the ends 33 thereof outwardly project under the seat 13 toward opposite sides of the water closet rim 15.

The modified closet ring 37 is installed in the floor 44 of the room in which the water closet is located in a normal manner of installation of such rings. Once the water closet 14 has been properly set on the modified closet ring 37, the flattened exhaust hose 19 is connected thereto by sliding it up and over lip 40 of projection 39. Thus it can be seen that the interior of exhaust line 19 communicates through passageway 42 to the interior 43 of such closet ring and into the sewer system connected thereto.

Next, the pressure switch 28 is mounted on the underside 13' of seat 13 in the area adjacent to the front of the water closet 14 as can clearly be seen in FIG. 1.

The cord 36 is secured along the bottom 13' of seat 13 by cord clips or other suitable means (not shown).

With the improved evacuation system 10 of the present invention mounted as described above on the water closet 14, the same is ready for operation when the plug 21 of cord 20 is plugged into receptacle 22 in the normal manner.

The single-pole, double-throw switch 23 can be placed in the "RUN" position which sends power through conductors 24 and 25 to turn the wet/dry vacuum bypass motor 26 on with continuous vacuum being created at the ends of hose inlets 33 and blown into the sewer through hose 19.

If it is desired to have intermittent use of the evacuation system of the present invention, the switch 23 is placed in the "TIMER" position. When pressure such as someone sitting on seat 13 turns pressure switch 28 on, current will flow therethrough and to timer 30 and from there through conductors 31 and 25 to evacuation motor 26. Once a predetermined period of time has elapsed after pressure has been removed from pressure switch 28, the timer 30 will turn the evacuation system off. Conductor 27'' allows current to continue to flow through the timer 30 once switch 28 has been opened until the predetermined time of operation has elapsed. This can be anywhere from one minute to an extended period of time.

Should an overflow of the toilet bowl 13 occur, due to the location of the inlet ends 33 of hoses 12 juxtaposed to the upper surface of rim 15, a substantial amount of the water and/or debris carried thereby can be evacuated by turning switch 23 on "RUN." The water and/or debris will pass through flexible inlet hoses 12, out through exhaust hose 19 and into the structure sewer system connected to modified closet ring 37.

After an overflow has occurred as described above or a liquid from any other source is on the floor 45, the seat 13 can be raised as shown in FIG. 5 and an auxiliary hose 45 connected to one of the inlet ends 33 of one of the hoses 12. The other inlet end can be sealed by means such as cap 45.

Once the auxiliary hose 45 has been set up as described above, the switch 23 can be turned on "RUN" and the end of 45' of such hose placed adjacent the floor 44 so that the liquid thereon can be evacuated from such floor and deposited in the sewer system as hereinabove described.

Once all of the water and debris on the floor 44 has been evacuated by the auxiliary flexible hose 45, the same as well as the cap 43 can be removed from the inlet ends 33 of inlet hoses 12. The seat can then be lowered to the position shown in FIG. 1 and switch 23 turned to "TIMER" position. The evacuation system 10 is again ready for automatic operation.

The inlet hoses 12 can be readily removed from keeper 13 as well as from the wet/dry vacuum motor 26 within housing 11. Such housing can also be readily removed from the rear portion 17 of water closet 14 and the exhaust hose 19 can also be easily disconnected. Thus it can be seen that the means of the present invention can be conveniently removed from the water closet for cleaning and sanitizing.

The above is particularly advantageous since bacteria, viruses, fungi and other undesirable mediums can easily enter into the evacuation system due to the susceptible environment in which it is operated.

The intervals between maintenance as described above will, of course, depend on the frequency of use, the manner of use, and other factors.

If desired or deemed necessary, valves, water traps, or other suitable means can be provided in the flow path of the present invention to prevent back pressure odors from back flowing through such system when the motor associated therewith is not running. Since valves, water traps and the like are well know to those skilled in the art, further detailed discussion of the same is not deemed necessary. Also in some instances it may be desirable or necessary to dispose of the fluid discharge in a different manner than previously described.

From above it can be seen that the present invention discloses a relatively simple and yet highly efficient evacuation system for use in conjunction with water closets. Said system can evacuate both liquid and gaseous fluids and deposit the same in the normal sewer system associated with such water closet. The system can also be used for evacuating water and other debris from the floor adjacent the closet. The present invention is easy to clean and disinfect, and the various components can be readily replaced as needed.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A fluid evacuation system for use with a conventional water closet having a bowl with an upper surface surrounding a waste receiving opening and a seat mounted on the upper surface:

a wet/dry vacuum by pass source including a by pass motor adapted to be removably mounted to a rear portion of said water closet, said source having at least one inlet and one outlet;

a keeper having means for attachment to the upper surface of the bowl, said keeper being of a size so as to fit between the bowl upper surface and an under surface of the seat; said keeper having at least one passageway extending there through;

means for conducting fluid from said one outlet to a sewer pipe;

at least one vacuum hose being received in said passageway of said keeper such that said hose is releasably frictionally retained by said passageway with an open end of said hose extending through said passageway for disposition adjacent said waste receiving opening for removal of noxious odors through said at least one vacuum hose to said at least one inlet for passage through said vacuum source and said outlet to a sewer pipe; an auxiliary hose being attachable at one end to said open end of said at least one vacuum hose such that an opposite end of said auxiliary hose may be used to vacuum water from a floor adjacent said bowl

2. The system of claim 1 wherein a switch is provided for controlling the operation of said motor.

3. The system of claim 2 wherein said switch includes a timer.

4. The system of claim 3 wherein said timer is activated by a pressure switch.

5. The system of claim 4 wherein said pressure switch is disposed between the bottom of said seat and the top of said bowl whereby when a person sits on said seat, said pressure switch will be closed.

6. The system of claim 1 wherein a modified closet ring having a passageway through the side thereof is disposed beneath said water closet with one end of said passageway being communicatively connected to said outlet and the other end of such passageway being open to the interior of said ring whereby fluids evacuated from the area adjacent said bowl can be exhausted into the sewer system associated with said water closet.

7. The system of claim 1 wherein said bypass motor is enclosed within a housing.

8. The system of claim 7 wherein said housing is removably mounted on the rear portion of said water closet whereby said system can be readily removed from said water closet for maintenance, cleaning, and disinfecting.

9. The system of claim 8 wherein the means for removably mounting said housing on said water closet is a hook and loop type fastener.

* * * * *